US006955130B2

(12) United States Patent
Phillips

(10) Patent No.: US 6,955,130 B2
(45) Date of Patent: Oct. 18, 2005

(54) READING AND WRITING CENTER

(76) Inventor: James Joseph Phillips, RR#3, Arthur, Ontario (CA), N0G 1A0

( * ) Notice: Subject to any disclaimer, the term of this patent is extended or adjusted under 35 U.S.C. 154(b) by 0 days.

(21) Appl. No.: 10/391,955

(22) Filed: Mar. 19, 2003

(65) Prior Publication Data

US 2003/0177959 A1 Sep. 25, 2003

Related U.S. Application Data

(60) Provisional application No. 60/365,647, filed on Mar. 19, 2002.

(51) Int. Cl.[7] ..... A47B 57/00

(52) U.S. Cl. ..... 108/96; 108/189; 248/441.1; 211/186; 211/88.02; 434/408; 434/429

(58) Field of Search ..... 108/92, 93, 96, 108/177, 178, 187, 189; 211/186, 135, 42, 88.02; 434/408, 415, 413, 417, 429; 248/441.1, 127, 129

(56) References Cited

U.S. PATENT DOCUMENTS 1,664,036 A * 3/1928 Jarvis ..... 108/187
1,680,056 A * 8/1928 Mathias ..... 434/84
1,929,768 A * 10/1933 Bixby ..... 108/96
1,984,845 A * 12/1934 Smith et al. ..... 434/417
2,485,517 A * 10/1949 Vaule et al. ..... 434/413
3,149,724 A * 9/1964 Magers ..... 211/42
4,427,391 A * 1/1984 Berman ..... 434/408
4,802,595 A * 2/1989 Northington ..... 211/88.02
5,263,424 A * 11/1993 Kelly et al. ..... 108/91
D380,232 S * 6/1997 Egan et al. ..... D20/10
5,941,713 A * 8/1999 Wayner et al. ..... 434/408

FOREIGN PATENT DOCUMENTS

FR 2547179 * 12/1984 ..... 248/441.1
JP 06143889 * 5/1994 ..... 434/408

* cited by examiner

*Primary Examiner*—Lanna Mai
*Assistant Examiner*—Hanh V. Tran

(57) ABSTRACT

A teaching center is provided with first and second upstanding frame sections separated by two or more lateral connectors to form a generally "H" shaped frame. The second upstanding frame section is vertically oriented and the first upstanding frame section is inclined from the vertical to permit the use of storybooks, chart paper or other items that lean back. The teaching center is provided with one or more shelves or storage devices between the first and second upstanding frame sections.

10 Claims, 6 Drawing Sheets

READING AND WRITING CENTER

CROSS REFERENCE TO RELATED APPLICATION

This application claims priority from U.S. Provisional Application No. 60/365,647, filed Mar. 19, 2002, which is incorporated by reference as if fully set forth.

BACKGROUND OF THE INVENTION

1. Field of the Invention

This invention relates to educational furniture and in particular, teaching centers.

2. Description of the Prior Art

With the use of traditional "A" frame teaching easels, which many teachers use in a classroom environment, functionality is limited and floor space underutilized. Creating more classroom floor space helps overcome the problem of limited classroom floor space and therefore provides more room and opportunities for students to learn and teachers to teach. Class size is a major problem and an issue for most school districts. The base of the "A" frame easel, being the widest section of the easel, uses floor space.

Other problems associated with traditional teaching aids is the desirability of keeping teaching supplies close at hand for the teacher vs. a separate area or product for them to keep their supplies. Traditional "A" frame easels come to a point at the top and therefore limit the amount of usable space within the easel. With both sides of the easel angled inwards and coming to a point at the top, as the easel rises from the floor available space within the easel decreases at an equal amount on both sides. "A" frame easels with storage on the inside of the "A" provide for a limited amount of storage capacity and decreases to zero available capacity at the top of the A. (Looking at the letter A resembles the side view of an "A" frame easel with the horizontal slash being a shelf.) The space within the A frame and the space outside the frame are underutilized.

Floor space is used by the base, and as the A frame easel rises, floor space becomes less utilized. The "A" frame design also limits it's use. Hanging anything vertically isn't possible since both sides are angled. It also prevents teachers from having a storage area at the top of the easel for items they want to keep out of reach from children.

SUMMARY OF THE INVENTION

It is an object of the present invention to provide devices to help overcome the problems of underutilized classroom floor space, inadequate storage capacity, and the accessibility of teaching supplies.

Thus in accordance with the present invention there is provided a teaching center comprising first and second upstanding frame sections which are connected by two or more lateral connectors to form a generally "H" shaped frame, said second upstanding frame section being vertically oriented and said first upstanding frame section being inclined from the vertical to permit the use of storybooks, chart paper or other items that lean back. In a preferred embodiment the teaching center of the present invention is provided with one or more shelves or storage devices between the first and second upstanding frame sections.

This invention overcomes the problem of underutilized classroom floor space. This invention provides classroom teachers with a combined teaching center and storage center. The design allows for maximum usage of classroom floor space. With the use of traditional teaching easels, which most teachers use in a classroom environment, floor space is very underutilized. Creating more classroom floor space helps overcome the problem of limited floor space and therefore provides more space for students to learn and teachers to teach. With class size being a major problem, this invention helps reduce the severity of the problem.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENTS

Figure 1:
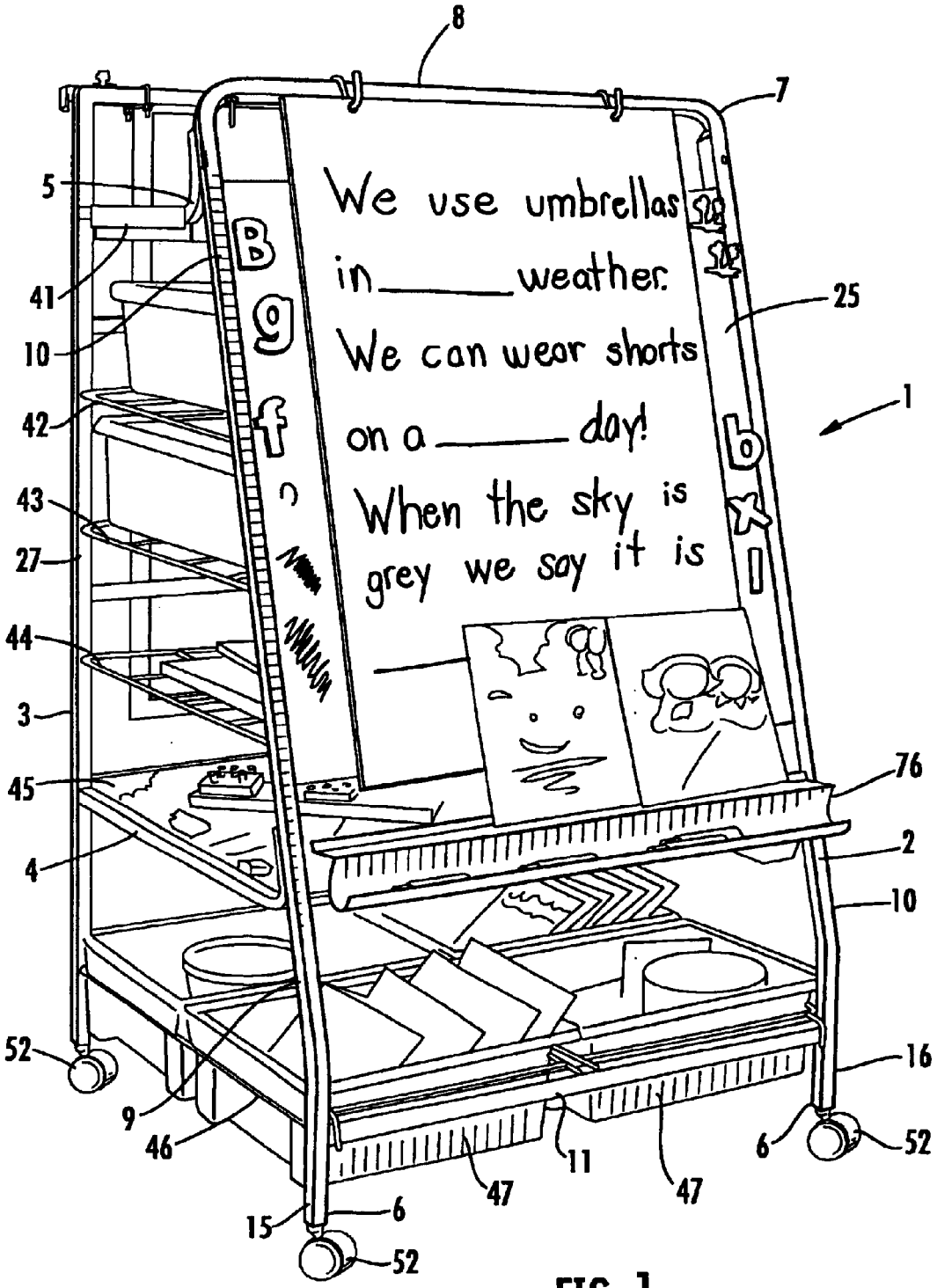
FIG. 1 is a perspective view of one embodiment of a teaching center according to the present invention.

As shown in the attached drawings a preferred embodiment of the teaching center 1 of the present invention comprises a first upstanding frame section 2 and a second upstanding frame section 3. The first and second upstanding frame sections 2,3 are joined by one or more lateral connectors (spacer members) 4,5 to form, from a side view, a generally "H" shaped teaching center. The first upstanding frame section 2, forming the one side of the H, is inclined from bottom 6 to top 7 and the second upstanding frame section 3 is substantially vertical when the two frame sections 2,3 are connected. The two upstanding frame sections 2,3 when connected by the lateral connectors 4,5 do not come to a point at the top 8 of the teaching center 1. Each upstanding frame section 2,3 is composed of vertical and horizontal frame members forming a generally rectangular frame section.

Figure 2:
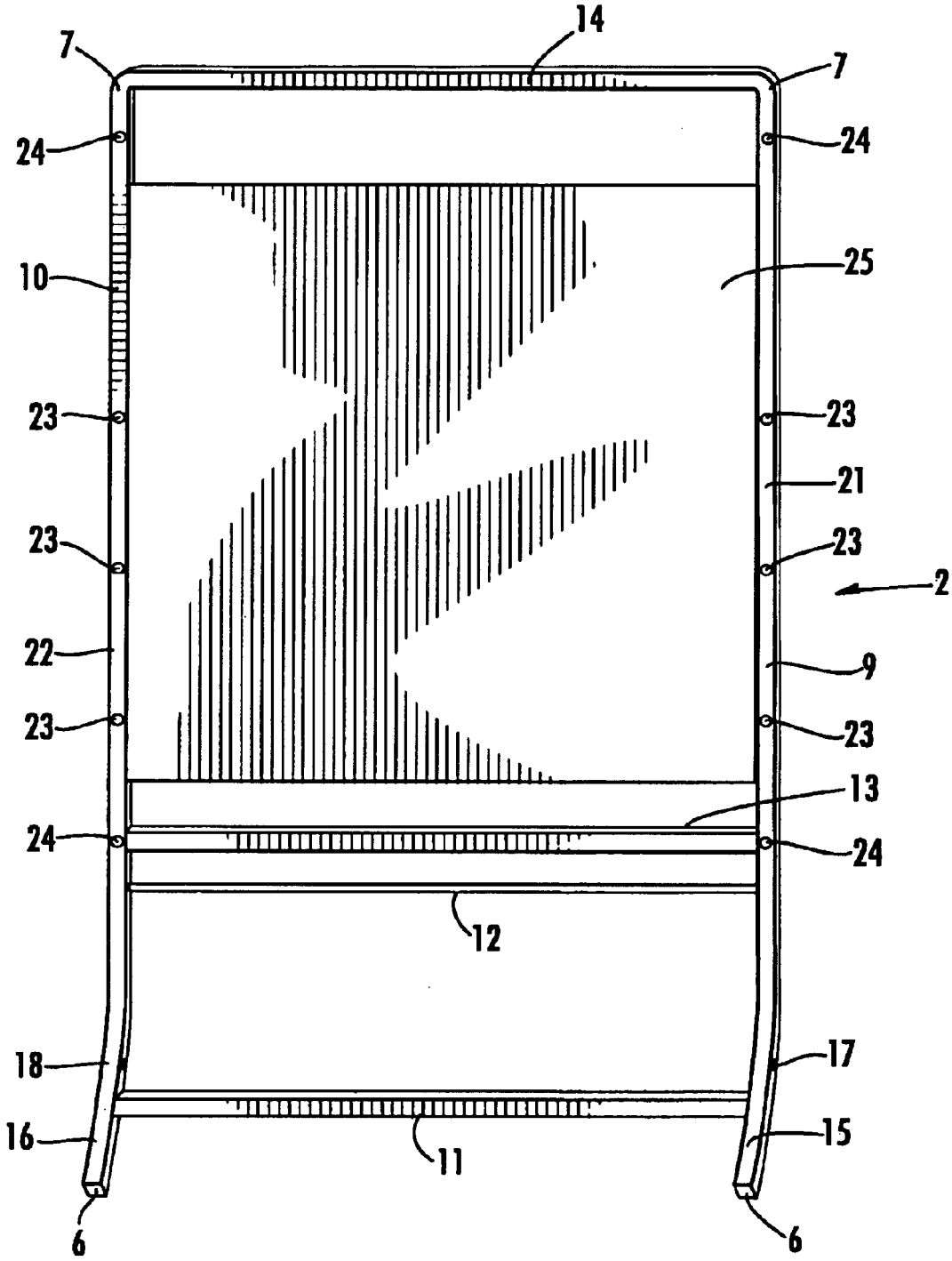
FIG. 2 is a front view of a first upstanding frame section of the teaching center of FIG. 1.

FIG. 2 illustrates the backside of one embodiment of the first upstanding frame section 2. It has two parallel vertical frame members 9,10 connected by horizontal frame members 11,12,13,14. The bottom end 15,16 of each of the vertical frame members 9,10 is bent at points 17,18. The portion 19,20 of the vertical frame members 9,10 below the bend points 17,18 are vertical when the two upstanding frame sections are connected and the portion 21,22 of the vertical frame members 9,10 above the bend points 17,18 are inclined. In the embodiment shown the vertical frame members 9, 10 and top horizontal frame member 14 are formed from a single piece of square tubing bent to the desired configuration shown. In the preferred embodiment ¾" square 18 gauge CR tubing is utilized. Horizontal frame members 11 and 13 are also formed of similar square tubing and welded to the vertical frame members 9,10. The horizontal frame member 12 is formed of ¼" wire in the embodiment illustrated. Means are provided on the upstanding frame section 2 to attach various shelves between the two upstanding frame sections 2,3. In the embodiment shown this means for attaching various shelves includes a series of holes 23 provided in the vertical frame members 9,10. Additional holes 24 are provided for connection of the spacer members 4,5. A dry erase board 25 covers a portion of the front side of the first upstanding frame section 2. The dry erase board 25 is made of an appropriate material so that magnets can be used to attach or clip material to it.

Figure 3:
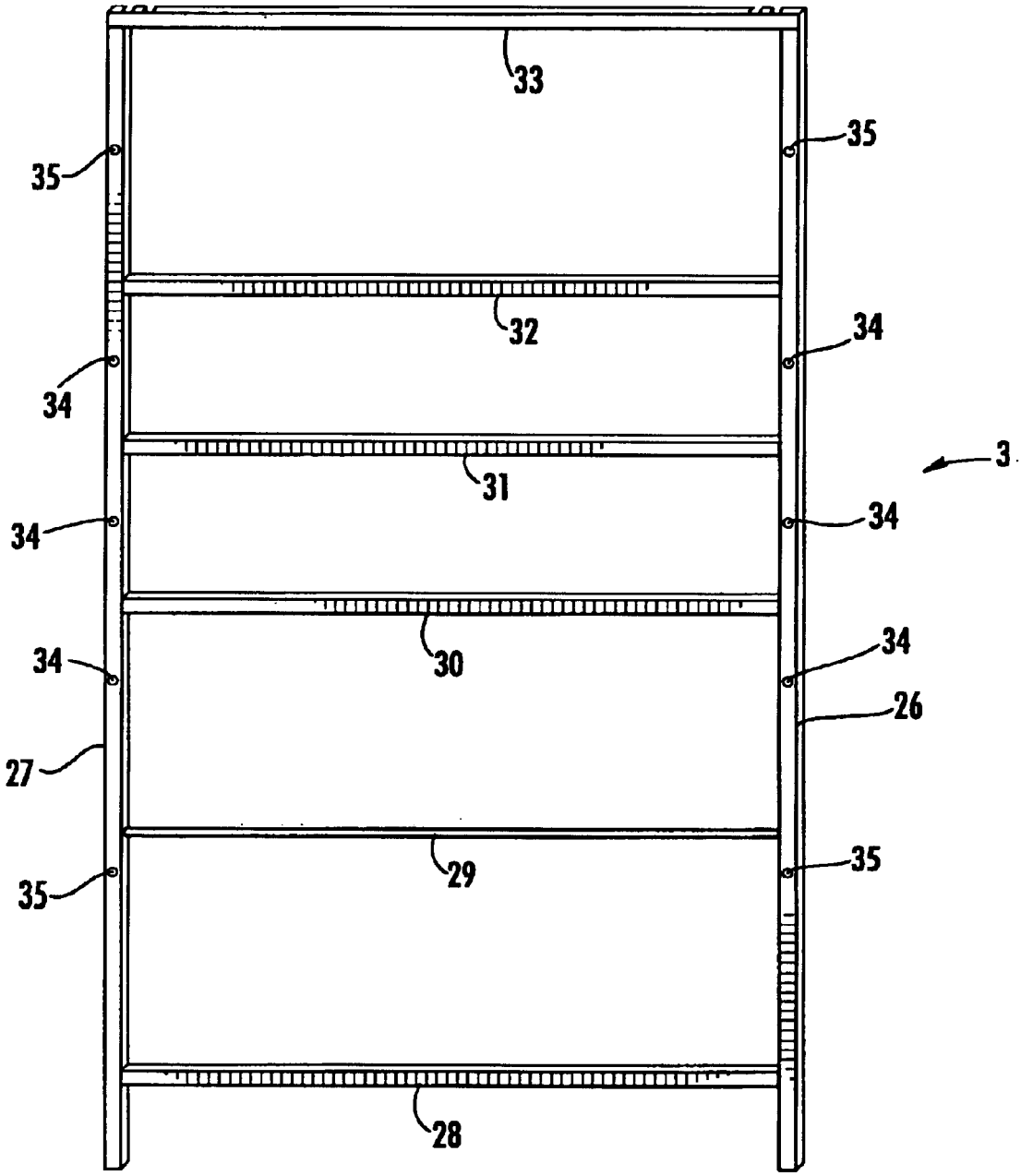
FIG. 3 is a back view of a second upstanding frame section of the teaching center of FIG. 1.

FIG. 3 illustrates the front side of one embodiment of the second upstanding frame section 3. It has two parallel vertical frame members 26,27 connected by horizontal frame members 28,29,30,31,32,33. In the embodiment shown the vertical frame members 26, 27 are formed from square tubing bent. In the preferred embodiment ¾" square 18 gauge CR tubing is utilized. Horizontal frame members 28,30,31,32,33 are also formed of similar square tubing and welded to the vertical frame members 26,27. The horizontal frame member 29 is formed of ¼" wire in the embodiment illustrated. Means are provided on the upstanding frame section 3 to attach various shelves between the two upstanding frame sections 2,3. In the embodiment shown this means for attaching various shelves includes a series of holes 34 provided in the vertical frame members 26,27. Additional holes 35 are provided for connection of the lateral connectors 4,5. Casters 52 are preferably provided on the bottom of the first and second upstanding frame sections to permit easy movement of the teaching center 1 around the classroom.

Figure 4:
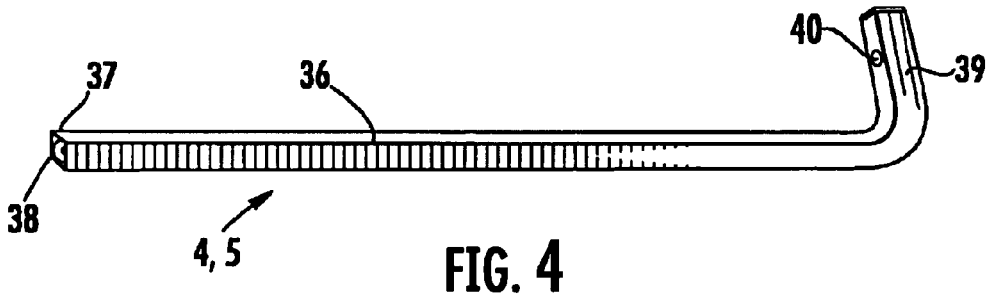
FIG. 4 is a side view of a lateral connector/spacer member for connecting the first and second upstanding frame sections of FIGS. 2 and 3.

FIG. 4 illustrates a lateral connector/spacer member 4,5 for use with the present invention. The spacer member 4,5 consists of a straight section 36 and means to connect the spacer member to the upstanding frame sections 2,3. In the embodiment shown, in a first end 37 of the straight section 36, is a welded insert 38. The welded insert 38 permits a screw or bolt (not shown) or other suitable fastener to connect the spacer member 4,5 to the second upstanding frame section 3 through hole 35. The second end 39 of straight section 36 is bent upwards, preferably to form an interior angle of 74° with the straight section 36. A hole 40 in the second end 39 permits attachment by a screw or bolt (not shown) or other suitable fastener to connect the spacer member 4,5 to the first upstanding frame section 2 through hole 24. Spacer members 4,5 differ in the length of the straight section 36. Both spacer members in the embodiment shown are made of ¾" square 18 gauge CR tubing.

Figure 5:
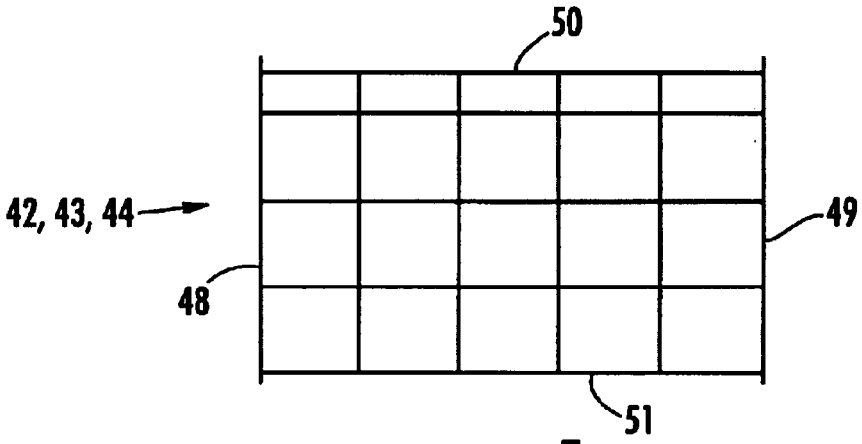
FIG. 5 is a top plan view of a middle wire shelf for the teaching center of FIG. 1.

One or more wire racks may be provided between the frame sections for holding books, tubs or other storage needs. In the embodiment shown in FIG. 1, there is a top shelf 41, three middle wire shelves 42,43,44, a bottom shelf 45 and a bottom bin rack 46 containing four plastic bins 47. FIG. 5 illustrates one of the middle wire shelves 42,43,44. Each of these shelves varies in width to fit the space between the upstanding frame sections 2,3 at the point of attachment of each shelf. The shelves are made of ¼" wire rods arranged in a square grid. The end rods 48,49 project beyond the outer longitudinal rods 50,51 and can be inserted into holes 23 on the first upstanding frame section 2 and holes 34 on the second upstanding frame section 3 to hold the middle wire shelves 42,43,44 in place. While these shelves are illustrated as wire shelves that could be made of other materials. Various items can be stored on the shelves 42,43,44 from books to other items such as storage bins as shown in FIG. 1.

Figure 6:
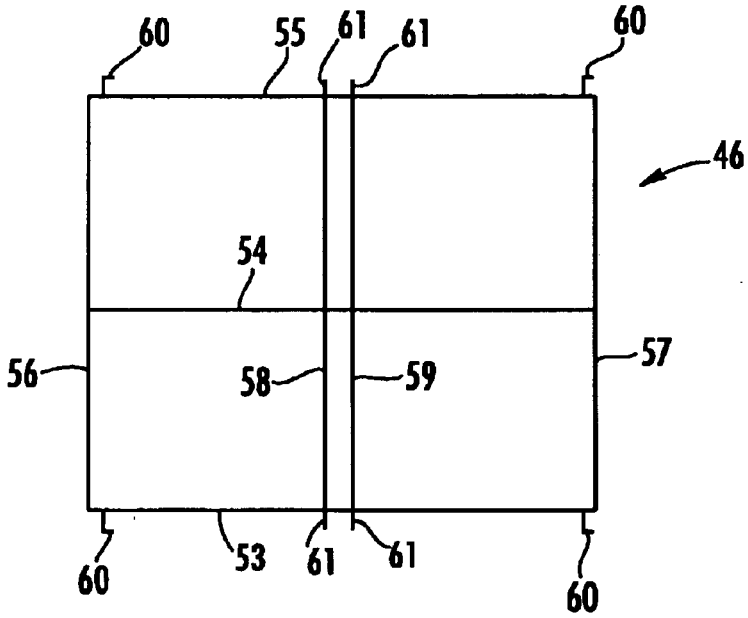
FIG. 6 is a top plan view of a bottom bin rack for the teaching center of FIG. 1.
Figure 8:
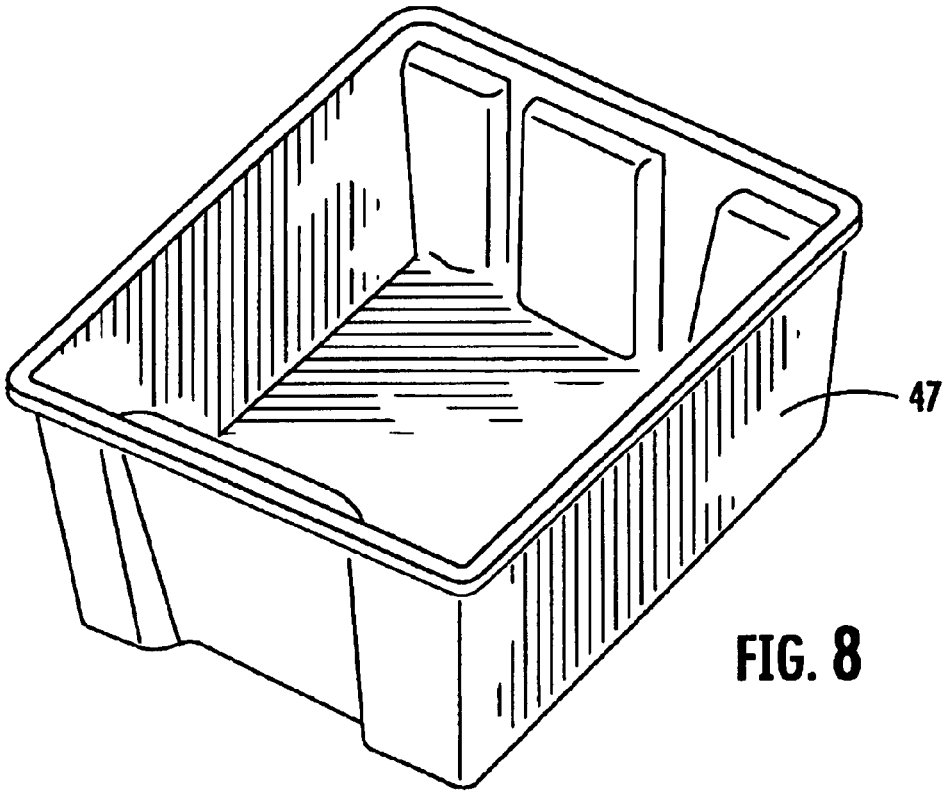
FIG. 8 is a top view of a bin to fit in the bottom bin rack of FIG. 6.

In FIG. 6 a bottom bin rack 46 for the teaching center 1 is illustrated. The bottom bin rack 46 is formed from metal rod welded together where the rods intersect. In the preferred embodiment, rods 53,54,55 are formed from ¼" bar. The two end rods 56,57 and two middle rods 58,59 are made of 5/16" bar. Means are provided to support the bin rack 46 on the horizontal frame members 11,28 of the first and second upstanding frame sections 2,3. In the embodiment shown, the means to support the bin rack 46 comprises hooks 60 welded to the bars 53,55 so that the hooks fit over the horizontal frame members 11,28. The ends 61 of the two middle rods 58,59 extend beyond rods 53,55 to rest on the top of the horizontal frame members 11,28. Bins 47 (shown in FIG. 8) fit into the bottom bin rack 46 as shown in FIG. 1.

Figure 7:
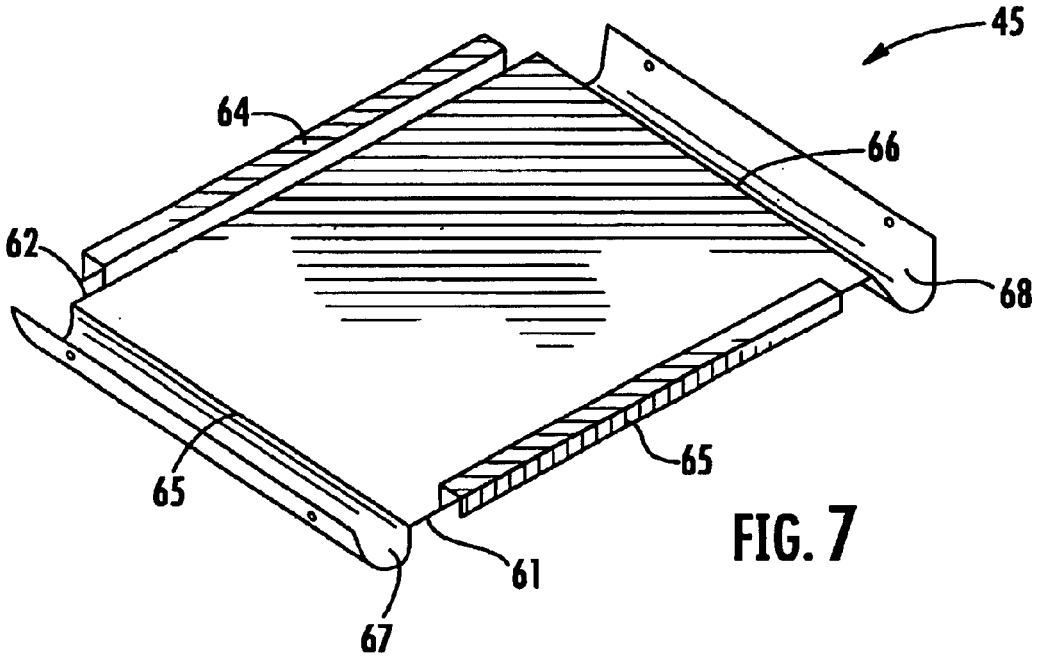
FIG. 7 is a top view of a bottom shelf for the teaching center of FIG. 1.

The bottom shelf 45, shown in FIG. 7, is made of a generally flat rectangular sheet of material. Along opposite sides 61,62 means are provided to support the bottom shelf 45 on horizontal frame members 12,29 of the first and second upstanding frame sections 2,3. In the embodiment shown the sides 61,62 of shelf 45 are bent to form downward opening channels 63,64 that are sized to fit over horizontal frame members 12,29 of the first and second upstanding frame sections 2,3. On the other sides 65,66 of shelf 45 the sheet is bent to form to troughs 67,68 to hold various items such as writing and language supplies.

Figure 9:
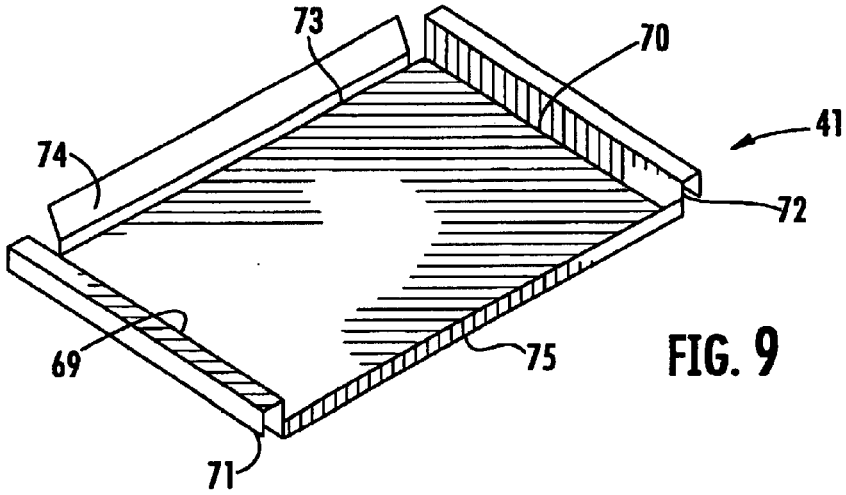
FIG. 9 is a top view of a top shelf for the teaching center of FIG. 1.

A top shelf 41 is preferably provide on the inside of the second frame section adjacent the top 8 of the teaching center 1 preferably with a built in pencil and marker tray for items that are intended for the teacher's hands only. FIG. 9 illustrates a preferred embodiment of the top shelf 41. The top shelf 41 is made of a generally flat rectangular sheet of material. Along opposite sides 69,70 means are provided to support the top shelf 41 on spacer members 5 connecting the first and second upstanding frame sections 2,3. In the embodiment shown the sides 69,70 of shelf 41 are adapted to form downward opening channels 71,72 that are sized to fit over spacer members 5. One of the other sides 73 of shelf 41, adjacent the second upstanding frame section 3, is bent to form a trough 74 to hold various items such as pencils and markers and other items that are intended for the teacher's hands only. On the other side 75 of shelf 41, adjacent the first upstanding frame section 2, the sheet is bent upwards to form a brake/stop.

Figure 10:
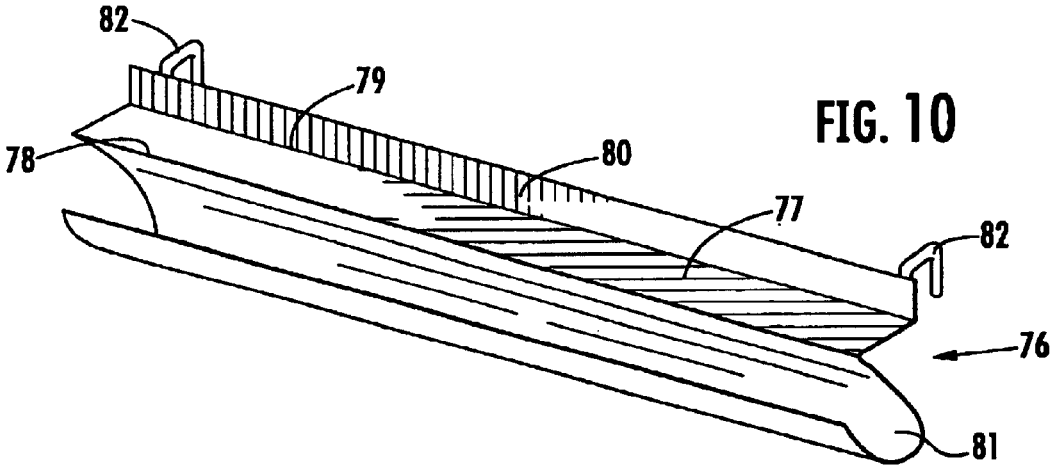
FIG. 10 is a top view of a book ledge/pencil trough for the teaching center of FIG. 1.
Figure 11:
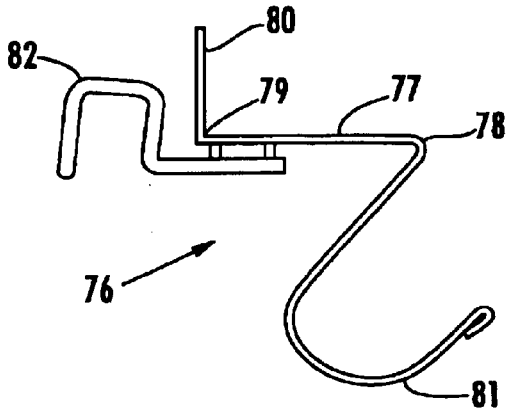
FIG. 11 is an enlarged end plan view of the book ledge/pencil trough of FIG. 10.

A removable and adjustable book ledge/pencil trough 76 is illustrated in FIGS. 10 and 11. The book ledge/pencil trough 76 comprises a ledge section 77 having front and back edges 78,79 respectively. Along the back edge 79 is an upstanding flange 80. Along the front edge 78 is a depending trough section 81. Means are provided for removable and adjustable attachment to the teaching center 1. In the preferred embodiment illustrated, the means for attachment comprises two hook members 82 spot-welded to the bottom of the ledge section 77. Hooks 82 are sized and shaped to fit over horizontal frame member 13 on the first upstanding frame section 2. In the embodiment shown the removable and adjustable book ledge/pencil trough 76 is formed from a sheet of 20-gauge sheet metal and the hooks are made of ¼" bar stock. The ledge section 77 acts as a big book holder and trough section 81 acts as a marker/pencil holder.

Having one frame section inclined or angled allows for the use of storybooks, chart paper or the use of other items that must lean back for the teacher to teach. Having the other frame section straight allows for the efficient use of floor space by maximizing storage space within the center.

Having one frame section vertical also allows for the use of items that must be hung vertically. Hooks and clips can be provided to hang items from the horizontal frame members 33,32,31,30 of the second upstanding frame section 3. This invention provides for the use of the top of the teaching center again utilizing classroom floor space. At the top corners of each frame section removable and adjustable hooks can be provided for hanging chart paper or pocket charts. Some of the hooks can be telescoping to permit charts up to 52" wide to be used. Magnetic bulldog clips can be provided for attaching items to the dry erase board 25.

Although various preferred embodiments of the present invention have been described herein in detail, it will be appreciated by those skilled in the art, that variations may be made thereto without departing from the spirit of the invention.

What is claimed is:

1. A teaching center comprising:

a first upstanding frame section having two parallel side frame members, said two parallel side frame members each having a bottom end and top end, each of the side frame members being bent at bend points close to the bottom end of each of said parallel side frame members such that a first portion of each of the side frame members below the bend points are vertical and a second portion of the frame members above the bend points are inclined from the vertical;

an upper cross frame member having apposite ends connected to the top end of each of said parallel side frame members;

a bottom cross frame member having opposite ends connected to said parallel side frame members below the bend points in said parallel side frame members;

a second upstanding frame section having two vertical side frame members, said two vertical side frame members each having a bottom end and top end and connected by two or more horizontal frame members;

a pair of upper lateral connectors each having a front end and a back end, the front end of the pair of upper lateral connectors connected adjacent the top end of the two parallel side frame members of said first upstanding frame section and the back end of the pair of upper lateral connectors connected adjacent the top end of the two vertical side frame members of said second upstanding frame section;

a pair of lower lateral connectors each having a front end and a back end, the front end of the pair of lower lateral connectors connected to the two parallel side frame members of said first upstanding frame section above the bend points and the back end of the pair of upper lateral connectors connected to the two vertical side frame members of said second upstanding frame section;

a plurality of horizontal shelves located between said first and second upstanding frame section above the bend points in the parallel side frame members of said first upstanding frame section;

a top section of a front side of the first upstanding frame section is covered by a dry erase board; and a book ledge on the front side of the first upstanding frame section below said dry erase board to permit the use of storybooks, chart paper or other items that lean back.

2. A teaching center according to claim 1 wherein said plurality of horizontal shelves located between said first and second upstanding frame sections above the bend points in the parallel side frame members of said first upstanding frame section include a top shelf adapted for support on the pair of upper lateral connectors and one or more middle racks.

3. A teaching center according to claim 2 wherein said top shelf has a tray for items that are intended for a teacher's hands only.

4. A teaching center according to claim 1 wherein said book ledge is removable and adjustable.

5. A teaching center according to claim 1 wherein said book ledge has a ledge section with front and back edges, an upstanding flange along the back edge of said ledge section, a depending trough section along the front edge and means for removable and adjustable attachment to the teaching center.

6. A teaching center according to claim 5 wherein the means for removable and adjustable attachment comprises two hook members spot welded to the bottom of the ledge section said hook members sized and shaped to fit over a middle cross frame member having opposite ends connected to said parallel side frame members of the first upstanding frame section above the bend points in said parallel side frame members and the vertical side frame members of said second upstanding frame section.

7. A teaching center according to claim 1 further including a bottom bin rack located between said first and second upstanding frame sections below the bend points in the parallel side frame members of said first upstanding frame section.

8. A teaching center according to claim 7 wherein said bottom bin rack is formed of metal rods defining a plurality of openings with a bin located in each of said openings.

9. A teaching center according to claim 7 wherein said bottom bin rack has hook means at opposite ends of at least a pair of said metal rods, said hook means adapted to support said bottom bin rack on the bottom cross frame member below the bend points in the parallel side frame members of the first upstanding frame section and a bottom horizontal frame member of said second upstanding frame section.

10. A teaching center according to claim 1 further including a plurality of attachment means on the second upstanding frame section to vertically hang one or more items selected from the group consisting of chart paper, charts, posters, maps, and pocket charts.

* * * * *